US006686115B1

(12) United States Patent
Dickerson et al.

(10) Patent No.: US 6,686,115 B1
(45) Date of Patent: Feb. 3, 2004

(54) BLUE-SENSITIVE FILM FOR RADIOGRAPHY WITH DESIRED IMAGE TONE

(75) Inventors: Robert E. Dickerson, Hamlin, NY (US); Richard F. Davis, Rochester, NY (US); Susan K. Mroczek, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/397,115

(22) Filed: Mar. 26, 2003

(51) Int. Cl.[7] ..... G03C 5/17; G03C 1/015; G03C 1/047; G03C 1/046; G03C 1/34

(52) U.S. Cl. ..... 430/139; 430/434; 430/502; 430/567; 430/569; 430/611; 430/642; 430/966; 430/967

(58) Field of Search ..... 430/139, 434, 430/567, 569, 642, 966, 967, 611

(56) References Cited

U.S. PATENT DOCUMENTS

| | | | | |
|---|---|---|---|---|
| 4,013,470 A | | 3/1977 | Landon, Jr. | |
| 4,425,425 A | * | 1/1984 | Abbott et al. | 430/502 |
| 4,425,426 A | * | 1/1984 | Abbott et al. | 430/502 |
| 4,713,320 A | * | 12/1987 | Maskasky | 430/567 |
| 4,728,601 A | | 3/1988 | Rowland et al. | |
| 5,219,720 A | * | 6/1993 | Black et al. | 430/567 |
| 5,256,519 A | | 10/1993 | Adin | |
| 5,292,627 A | | 3/1994 | Hershey et al. | |
| 5,292,631 A | | 3/1994 | Hershey et al. | |
| 5,629,142 A | * | 5/1997 | Maskasky | 430/502 |
| 5,759,759 A | | 6/1998 | Adin et al. | |
| 5,800,976 A | | 9/1998 | Dickerson et al. | |
| 5,876,913 A | | 3/1999 | Dickerson et al. | |
| 6,348,293 B1 | * | 2/2002 | Verbeeck et al. | 430/502 |
| 6,350,554 B1 | * | 2/2002 | Dickerson et al. | 430/502 |

FOREIGN PATENT DOCUMENTS

| | | |
|---|---|---|
| GB | 1004302 | 9/1965 |
| GB | 1049052 | 11/1966 |
| GB | 1237541 | 6/1971 |
| GB | 1257750 | 12/1971 |

OTHER PUBLICATIONS

USSN 10/397691 (D–85620) Davis et al., titled *Blue–Sensitive Film For Radiography and Imaging Assembly and Method* filed on even date herewith.

USSN 10/397567 (D–85622) Dickerson et al., titled *Radiographic Imaging Assembly With Blue–Sensitive Film* filed on even date herewith.

* cited by examiner

*Primary Examiner*—Richard L. Schilling
(74) *Attorney, Agent, or Firm*—J. Lanny Tucker

(57) ABSTRACT

A blue-sensitive, radiographic silver halide film comprises a silver halide emulsion layer comprising predominantly tabular silver halide grains that have an aspect ratio of at least 15, a grain thickness of at least 0.1 $\mu$M, and comprise at least 90 mol % bromide and from about 0.5 to about 2.75 mol % iodide, based on total silver halide. Substantially all of the iodide is present in an internal localized portion of the tabular silver halide grains that excludes the surface of the grains. The tabular silver halide grains are dispersed in a hydrophilic polymeric vehicle mixture comprising at least 0.5% of oxidized gelatin, based on the total dry weight of the polymeric vehicle mixture in the emulsion layer. In addition, the tabular grain emulsion includes a mercapto-substituted benzothiazole, benzoxazole, or benzimidazole to provide desired image tone and processability.

20 Claims, No Drawings

BLUE-SENSITIVE FILM FOR RADIOGRAPHY WITH DESIRED IMAGE TONE

FIELD OF THE INVENTION

This invention is directed to radiography. In particular, it is directed to blue light-sensitive, radiographic silver halide films that provide improved medical diagnostic images with higher contrast, desired image tone, and have improved processing characteristics. This invention also provides an imaging assembly and a method of radiographic imaging using these improved radiographic films.

BACKGROUND OF THE INVENTION

The use of radiation-sensitive silver halide emulsions for medical diagnostic imaging can be traced to Roentgen's discovery of X-radiation by the inadvertent exposure of a silver halide film. Eastman Kodak Company then introduced its first product specifically that was intended to be exposed by X-radiation in 1913. The discovery of X-rays in 1895 provided the beginning of a new way of providing medical evaluation and diagnosis. Prior to that time, medical examination comprised predominantly manual probing and consideration of symptoms. Such examinations would obviously be incomplete and inconclusive in most instances, and incorrect in some instances. In some cultures, there was a prohibition of touching the female anatomy, further limiting the effectiveness of medical examination. Thus, the discovery that X-radiation could pass through the body with relatively little harm and provide useful images provided a powerful tool in medical diagnosis and treatment.

In conventional medical diagnostic imaging the object is to obtain an image of a patient's internal anatomy with as little X-radiation exposure as possible. The fastest imaging speeds are realized by mounting a dual-coated radiographic element between a pair of fluorescent intensifying screens for imagewise exposure. About 5% or less of the exposing X-radiation passing through the patient is adsorbed directly by the latent image forming silver halide emulsion layers within the dual-coated radiographic element. Most of the X-radiation that participates in image formation is absorbed by phosphor particles within the fluorescent screens. This stimulates light emission that is more readily absorbed by the silver halide emulsion layers of the radiographic element.

Examples of radiographic element constructions for medical diagnostic purposes are provided by U.S. Pat. No. 4,425,425 (Abbott et al.) and U.S. Pat. No. 4,425,426 (Abbott et al.), U.S. Pat. No. 4,414,310 (Dickerson), U.S. Pat. No. 4,803,150 (Dickerson et al.), U.S. Pat. No. 4,900,652 (Dickerson et al.), U.S. Pat. No. 5,252,442 (Tsaur et al.), and *Research Disclosure,* Vol. 184, August 1979, Item 18431.

Problem to be Solved

Some commercial radiographic films that are available from Eastman Kodak Company and Agfa-Gevaert are sensitive to blue light and designed to be used in combination with blue-emitting fluorescent intensifying screens such as those containing calcium tungstate as the phosphor. Those films generally contain high silver coverage in the form of grains having cubic or other 3-dimensional morphology. The emulsion layers in those films are relatively "soft" meaning that relatively low levels of film hardener are used, in order to maximize covering power and to reduce drying time after processing with wet chemistries. However, the higher silver coverage contributed to longer processing times.

In addition, the silver halide emulsions in such films are generally "internally fogged" meaning that the emulsion grains have internal latent image sensitivity. Such emulsions, when coated in combination with high silver iodide emulsions sufficient to release iodide upon development to render the internally fogged emulsion developable, results in higher covering power than would be possible with the silver iodide emulsions. This property can provide the advantage of lower silver coverage and improved processing compared to higher silver-containing films, but it is also disadvantageous in that if the developer is contaminated with photographic fixers from the fixing tank, the internally fogged emulsion is developer prematurely and provided high fogging ($D_{min}$).

Early radiographic films were processed manually in trays before automatic processors were available. Manual processing is still used to day in some parts of the world. This process generally requires the operator to visually determine if the processed film is "dark" enough and thus if development has proceeded for a sufficient period of time. Obviously, this process is prone to errors in image formation and varying sensitometric properties such as image tone.

Images can be identified as "cold" or "warm" depending upon where they fall within the noted color scale as defined by a* and b* values. A "cold" image would be one that is on the bluish side of neutral (that is, a negative b* value) and a "warm" image would be one that is the yellowish of positive b* side of neutral, both measured at a density of 1.0 (for dual-coated films). The a* value is a measure of redness (positive a* value) or greenness (negative a* value). Such measurements can be obtained using known techniques, for example as described by Billmeyer et al., *Principles of Color Technology,* $2^{nd}$ Ed., Wiley & Sons, New York, 1981, Chapter 3.

For medical diagnostic films, it is generally desired that the film exhibit a sufficiently cold image tone to provide a b* value more negative than −6.0 and preferably more negative than −7.0. This requires more than merely adding specific tinting dyes to the film support or silver halide emulsion layers, and when other components of the film are changed to acquire desirable sensitometric results, the image tone can also be changed in an undesirable fashion. For example, while known medical radiographic films exhibit the desired b* values (bluish tone), it has been found that when silver coverage is reduced, some of them exhibit an unacceptable green tint, particularly at high densities.

U.S. Pat. No. 5,876,913 (Dickerson et al.) describes radiographic films having reduced hydrophilic colloid in tabular grain emulsions to provide colder image tone. In addition, the patent describes the use of various "covering power enhancing" compounds such as various mercapto-substituted heterocycles such as 2-mercaptobenzothiazole. Additional compounds of this type are described in U.S. Pat. No. 4,013,470 (Landon, Jr.) for use in combination with quaternary ammonium salts in photographic prints to provide "warmer" image ones.

There is a desire in the industry to have "blue-sensitive" or "blue-light sensitive" radiographic films that have reduced silver coverage and improved processability without significant loss of desired sensitometric properties. In addition, it is desired to provide "colder" image tone in these films despite variations in process conditions and reduction in silver coverage.

SUMMARY OF THE INVENTION

The present invention provides a blue-sensitive, radiographic silver halide film comprising a support having first and second major surfaces, the radiographic silver halide film having disposed on the first major support surface, one or more hydrophilic colloid layers including a first silver halide emulsion layer, and on the second major support surface, one or more hydrophilic colloid layers including a second silver halide emulsion layer, the first silver halide emulsion layer comprising predominantly tabular silver halide grains that have an aspect ratio of at least 15, a grain thickness of at least 0.1 μm, and comprise at least 90 mol % bromide and from about 0.5 to about 2.75 mol % iodide, based on total silver halide, substantially all of the iodide being present in an internal localized portion of the tabular silver halide grains that excludes the surface of the grains, wherein the tabular silver halide grains in the first silver halide emulsion layer are dispersed in a hydrophilic polymeric vehicle mixture comprising at least 0.5% of oxidized gelatin, based on the total dry weight of the polymeric vehicle mixture, and wherein the first silver halide emulsion layer further comprises a mercapto-substituted benzothiazole, benzoxazole, or benzimidazole in an amount of at least 0.3 mmole per mole of silver in the silver halide emulsion layer.

In preferred embodiments, the present invention provides a blue-sensitive, radiographic silver halide film comprising a support having first and second major surfaces, the radiographic silver halide film having disposed on the first major support surface, one or more hydrophilic colloid layers including a first silver halide emulsion layer, and on the second major support surface, one or more hydrophilic colloid layers including a second silver halide emulsion layer, the first and second silver halide emulsion layers having essentially the same composition and comprising predominantly tabular silver halide grains that have an aspect ratio of from about 20 to about 30, a grain thickness of from about 0.10 to about 0.14 μm, and comprising at least 95 mol % bromide and from about 0.5 to about 2 mol % iodide, based on total silver halide in the emulsion layers, substantially all of the iodide being present in an internal localized portion of the tabular silver halide grains that from about 1.7 to about 85 volume % of the grains wherein 100% volume represents the surface of the grains, wherein the tabular silver halide grains in the first and second silver halide emulsion layers are dispersed in a hydrophilic polymeric vehicle mixture comprising from about 0.8% to about 1.2% of deionized oxidized gelatin, based on the total dry weight of the polymeric vehicle mixture, and wherein the first silver halide emulsion layer further comprises a 2-mercapto-1,3-benzothiazole, 2-mercapto-1,3-benzoxazole, or 2-mercapto-1,3-benzimidazole in from about 0.3 to about 1 mmole per mole of silver in the first silver halide emulsion layer.

This invention also provides a photosensitive silver halide emulsion comprising predominantly tabular silver halide grains that have an aspect ratio of at least 15, a grain thickness of at least 0.1 μm, and comprise at least 90 mol % bromide and from about 0.5 to about 2.75 mol % iodide, based on total silver halide, substantially all of the iodide being present in an internal localized portion of the tabular silver halide grains that excludes the surface of the grains, wherein the tabular silver halide grains are dispersed in a hydrophilic polymeric vehicle mixture comprising at least 0.3 g and up to 27 g of oxidized gelatin per mole of silver in the emulsion, and wherein the emulsion further comprises a mercapto-substituted benzothiazole, benzoxazole, or benzimidazole in an amount of at least 0.3 mmole per mole of silver in the silver halide emulsion.

Moreover, the invention also provides a radiographic imaging assembly comprising:

A) the blue-sensitive, radiographic silver halide film of the present invention as described herein, and B) a fluorescent intensifying screen that comprises an inorganic phosphor capable of absorbing X-rays and emitting electromagnetic radiation having a wavelength of from about 360 to about 540 nm, the inorganic phosphor being coated in admixture with a polymeric binder in a phosphor layer onto a flexible support and having a protective overcoat disposed over the phosphor layer.

A method of the present invention for providing a black-and-white image comprises exposing the radiographic imaging assembly of the present invention, and processing the blue-sensitive radiographic silver halide film, sequentially, with a black-and-white developing composition and a fixing composition, the processing being carried out within 90 seconds, dry-to-dry.

Further, a method of providing a black-and-white image comprises exposing the blue-sensitive radiographic silver halide film of the present invention, and processing it, sequentially, with a black-and-white developing composition and a fixing composition, the processing being carried out within 90 seconds, dry-to-dry.

These advantages are achieved by a combination of properties in the radiographic film emulsions. The emulsions of the invention films contain high aspect tabular grains that have a thickness of at least 0.1 μm and include from about 0.5 to about 2.75 mol % iodide based on total silver in localized portions of the grains. In addition, the coated tabular grains are dispersed in a hydrophilic polymeric binder mixture that includes at least 0.5 weight % of oxidized gelatin based on the total dry weight of the polymeric vehicle mixture. In addition, the emulsion includes at least 0.3 mmole per Ag mole of a mercapto-substituted benzothiazole, benzoxazole, or benzimidazole that provides higher covering power and desired image tone as well as improved development rates during manual processing.

DETAILED DESCRIPTION OF THE INVENTION

Definition of Terms

The term "contrast" as herein employed indicates the average contrast derived from a characteristic curve of a radiographic film using as a first reference point (1) a density ($D_1$) of 0.25 above minimum density and as a second reference point (2) a density ($D_2$) of 2.0 above minimum density, where contrast is $\Delta D$ (i.e. 1.75)÷$\Delta\log_{10}E$ ($\log_{10}E_2-\log_{10}E_1$), $E_1$ and $E_2$ being the exposure levels at the reference points (1) and (2).

"Gamma" is described as the instantaneous rate of change of a D logE sensitometric curve or the instantaneous contrast at any logE value.

"Photographic speed" for the radiographic silver halide films of this invention refers to the exposure necessary to obtain a density of at least 1.0 plus $D_{min}$ in the resulting black-and-white image.

Image tone can be evaluated using conventional CIELAB (Commission Internationale de l'Eclairage) a* and b* values that can be evaluated using the techniques described by Billmeyer et al., *Principles of Color Technology, 2nd* Edition, Wiley & Sons, New York, 1981, Chapter 3. The a* value is a measure of reddish tone (positive a*) or greenish tone (negative a*). The b* value is a measure of bluish tone (negative b*) or yellowish tone (positive b*). The noted CIELAB a* and b* values are indications of image tone as viewed by transmission. The values were determined by CIELAB standards for spectra recorded from 400 to 700 nm using D5500 as the standard illuminant. A difference of at least 0.7b* units or 0.2a* units is considered to be a noticeable difference for a standard observer.

"Blue-sensitive" refers to sensitivity of the silver halide emulsion to a wavelength of from about 360 to about 540 nm, and preferably it relates to a sensitivity to a wavelength of from about 380 to about 470 nm.

The term "fully forehardened" is employed to indicate the forehardening of hydrophilic colloid layers to a level that limits the weight gain of a radiographic film to less than 120% of its original (dry) weight in the course of wet processing. The weight gain is almost entirely attributable to the ingestion of water during such processing.

In referring to grains and silver halide emulsions containing two or more halides, the halides are named in order of ascending molar concentrations.

The term "aspect ratio" is used to define the ratio of tabular grain diameter to grain thickness. The tabular grain diameter is calculated form a disc-centrifuge measurement and the tabular grain thickness is determined from a reflectance measurement. Both measurements are performed using appropriate standards for calibration.

The term "covering power" is used to indicate 100 times the ratio of maximum density to developed silver measured in $mg/dm^2$.

The term "dual-coated" is used to define a radiographic film having silver halide emulsion layers disposed on both the front- and backsides of the support. The radiographic silver halide films used in the present invention are "dual-coated."

The term "fluorescent intensifying screen" refers to a screen that absorbs X-radiation and emits light. A "prompt" emitting fluorescent intensifying screen will emit light immediately upon exposure to radiation while a "storage" fluorescent screen can "store" the exposing X-radiation for emission at a later time when the screen is irradiated with other radiation (usually visible light).

The terms "front" and "back" refer to layers, films, or fluorescent intensifying screens nearer to and farther from, respectively, the source of X-radiation.

The term "rare earth" is used to indicate chemical elements having an atomic number of 39 or 57 through 71.

*Research Disclosure* is published by Kenneth Mason Publications, Ltd., Dudley House, 12 North St., Emsworth, Hampshire P010 7DQ England. It is also available from Emsworth Design Inc., 147 West 24th Street, New York, N.Y. 10011.

Radiographic Films

The radiographic silver halide films of this invention include a flexible support having disposed on both sides thereof, one or more photographic silver halide emulsion layers as described below and optionally one or more non-radiation sensitive hydrophilic layer(s). The silver halide emulsions in the various layers on both sides of the support can be the same or different.

In preferred embodiments, the photographic silver halide film has the same silver halide emulsion(s) on both sides of the support. It is also preferred that the film has a protective overcoat (described below) over the silver halide emulsions on each side of the support.

The support can take the form of any conventional radiographic film support that is X-radiation and light transmissive. Useful supports for the films of this invention can be chosen from among those described in *Research Disclosure,* September 1996, Item 38957 XV. Supports and *Research Disclosure,* Vol. 184, August 1979, Item 18431, XII. Film Supports.

The support is preferably a transparent film support. In its simplest possible form the transparent film support consists of a transparent film chosen to allow direct adhesion of the hydrophilic silver halide emulsion layers or other hydrophilic layers. More commonly, the transparent film is itself hydrophobic and subbing layers are coated on the film to facilitate adhesion of the hydrophilic silver halide emulsion layers. Typically the film support is either colorless or blue tinted (tinting dye being present in one or both of the support film and the subbing layers). Referring to *Research Disclosure,* Item 38957, Section XV Supports, cited above, attention is directed particularly to paragraph (2) that describes subbing layers, and paragraph (7) that describes preferred polyester film supports.

Polyethylene terephthalate and polyethylene naphthalate are the preferred transparent film support materials.

In the more preferred embodiments, at least one non-light sensitive hydrophilic layer is included with one silver halide emulsion layer on each side of he film support. This layer may be called an interlayer or overcoat, or both.

Each side of the support comprises one or more silver halide emulsion layers. On at least one of those sides (and preferably on both sides), at least one silver halide emulsion that contain predominantly tabular grains (that is, more than 60 weight % of all grains and preferably at least 80 weight %) having an average aspect ratio greater than 15. Preferably, these grains have an aspect ratio of from about 20 to about 30. The optimal aspect ratio may be dependent upon the particular mol % of iodide present in the grains.

The average thickness of these tabular grains is at least 0.1 $\mu$m with an upper limit of 0.15 $\mu$m, and preferably the tabular grain thickness is from about 0.10 to about 0.14 $\mu$m.

These tabular silver halide grains particularly include predominantly (at least 90 mol %) bromide, preferably at least 95 mol % bromide, and more preferably at least 97 mol % bromide, based on total silver in the emulsion layer. In addition, these tabular grains have up to 2.75 mol % iodide, and preferably up to 2 mol % iodide, based on total silver in the emulsion layer. Generally, the iodide content is at least 0.5 mol % and preferably at least 0.75 mol %, based on total silver in the emulsion layer. The tabular silver halide grains in each silver halide emulsion unit (or silver halide emulsion layers) can be the same or different, and there can be mixtures of tabular grains in an emulsion layer having different halide composition and aspect ratio as long as the conditions noted above are still met.

The silver halide emulsion layers on the opposing sides of the support are identified herein as "first" and "second" silver halide emulsion layers with the "first" layer being disposed on the side of the film that is exposed first. Preferably, these "first" and "second" silver halide emulsion layers have the same composition (for example, type of grains, grain halide composition, silver coverage, and hydrophilic polymeric vehicle mixture).

Thus, either or both of the first and second silver halide emulsion layers can have the same or different composition and comprise predominantly tabular silver halide grains that have an aspect ratio of at least 15, a grain thickness of at least 0.1 $\mu$m, and comprise at least 90 mol % bromide and up to 4 mol % iodide, based on total silver halide, substantially all of the iodide being present in an internal localized portion of the tabular silver halide grains that excludes the surface of the grains, wherein the tabular silver halide grains in the first and/or second silver halide emulsion layers are dispersed in a hydrophilic polymeric vehicle mixture comprising at least 0.5% of oxidized gelatin, based on the total dry weight of the polymeric vehicle mixture in the first and/or second emulsion layers, and wherein either or both silver halide emulsion layers comprise one or more of the mercapto-substituted benzothiazole, benzoxazole, or benzimidazole compounds as defined below.

Tabular grain emulsions that have the desired composition and sizes are described in greater detail in the following patents, the disclosures of which are incorporated herein by reference:

U.S. Pat. No. 4,414,310 (Dickerson), U.S. Pat. No. 4,425,425 (Abbott et al.), U.S. Pat. No. 4,425,426 (Abbott et al.), U.S. Pat. No. 4,439,520 (Kofron et al.), U.S. Pat. No. 4,434,226 (Wilgus et al.), U.S. Pat. No. 4,435,501 (Maskasky), U.S. Pat. No. 4,713,320 (Maskasky), U.S. Pat. No. 4,803,150 (Dickerson et al.), U.S. Pat. No. 4,900,355 (Dickerson et al.), U.S. Pat. No. 4,994,355 (Dickerson et al.), U.S. Pat. No. 4,997,750 (Dickerson et al.), U.S. Pat. No. 5,021,327 (Bunch et al.), U.S. Pat. No. 5,147,771 (Tsaur et al.), U.S. Pat. No. 5,147,772 (Tsaur et al.), U.S. Pat. No. 5,147,773 (Tsaur et al.), U.S. Pat. No. 5,171,659 (Tsaur et al.), U.S. Pat. No. 5,252,442 (Dickerson et al.), U.S. Pat. No. 5,370,977 (Zietlow), U.S. Pat. No. 5,391,469 (Dickerson), U.S. Pat. No. 5,399,470 (Dickerson et al.), U.S. Pat. No. 5,411,853 (Maskasky), U.S. Pat. No. 5,418,125 (Maskasky), U.S. Pat. No. 5,494,789 (Daubendiek et al.), U.S. Pat. No. 5,503,970 (Olm et al.), U.S. Pat. No. 5,536,632 (Wen et al.), U.S. Pat. No. 5,518,872 (King et al.), U.S. Pat. No. 5,567,580 (Fenton et al.), U.S. Pat. No. 5,573,902 (Daubendiek et al.), U.S. Pat. No. 5,576,156 (Dickerson), U.S. Pat. No. 5,576,168 (Daubendiek et al.), U.S. Pat. No. 5,576,171 (Olm et al.), and U.S. Pat. No. 5,582,965 (Deaton et al.).

The iodide present in the tabular silver halide grains described above is substantially all located in an "internal localized portion" of the grains. This means that substantially none of the iodide is present on the surfaces of the grains. This feature can be defined by the volume % of a grain wherein 0 volume % refers to the center of the grain and 100 volume % refers to the grain surface. In the present invention, the iodide is present in an internal localized portion at from about 1.5% to about 90 volume %. Preferably, the "beginning" of the internal localized portion is from about 1.5% to about 10 volume % and the "ending" of the internal localized portion is from about 65% to about 90 volume %. Thus, the nucleated internal portion of the grains contains no iodide. More preferably, the iodide is uniformly distributed throughout the internal localized portion represented by from about 1.7 to about 85 volume %.

This localization of the iodide within the tabular grains can be achieved using known procedures whereby preparation of the tabular grains is begun (nucleation and initial growth) without the presence of iodide. Then iodide is introduced during a predetermined portion of the manufacturing method until the desired volume % includes iodide, and manufacture of the grains is continued without iodide. A representative preparation is provided in the following paragraphs. Other details for making tabular grains in a similar manner are provided in U.S. Pat. No. 4,665,012 (Sugimoto et al.), incorporated herein by reference.

In general, the tabular grains useful in the practice of this invention can be prepared using a silver bromide-grain nucleation (and early growth) in a "bromide ion concentration free-fall" process with slow silver ion addition into a bromide ion-rich deionized oxidized gelatin environment. The number of grains having tabular morphology is enhanced using a brief period of silver solvent-enhanced digestion. After digestion, additional gelatin of any type (preferably oxidized gelatin and more preferably deionized oxidized gelatin) can be added. Further grain growth is then carried out by controlling the silver ion concentration in a halide-rich environment, using either bromide or iodobromide growth/control salts as required. Following grain growth, after washing out salts remaining in the solution phase of the emulsion, the emulsion is further peptized using a non-oxidized gelatin (preferably deionized, non-oxidized gelatin).

The silver halide emulsions described herein can have some non-tabular silver halide grains as long as they represent less than 40 weight % of the total grains in a given silver halide emulsion layer. Such grains can have any desirable morphology including, but not limited to, octahedral, tetradecahedral, rounded, spherical or other non-tabular or singularly-twinned or multiply-non-parallel twinned morphologies, or be comprised of a mixture of two or more of such morphologies.

A variety of silver halide dopants can be used, individually and in combination, to improve contrast as well as other common properties, such as speed and reciprocity characteristics. A summary of conventional dopants to improve speed, reciprocity and other imaging characteristics is provided by *Research Disclosure,* Item 38957, cited above, Section I. Emulsion grains and their preparation, sub-section D. Grain modifying conditions and adjustments, paragraphs (3), (4), and (5).

A general summary of silver halide emulsions and their preparation is provided by *Research Disclosure,* Item 38957, cited above, Section I. Emulsion grains and their preparation. After precipitation and before chemical sensitization the emulsions can be washed by any convenient conventional technique using techniques disclosed by *Research Disclosure,* Item 38957, cited above, Section III. Emulsion washing.

The emulsions can be chemically sensitized by any convenient conventional technique as illustrated by *Research Disclosure,* Item 38957, Section IV. Chemical Sensitization: Sulfur, selenium or gold sensitization (or any combination thereof) are specifically contemplated. Sulfur sensitization is preferred, and can be carried out using for example, thiosulfates, thiosulfonates, thiocyanates, isothiocyanates, thioethers, thioureas, cysteine or rhodanine. A combination of gold and sulfur sensitization is most preferred.

The silver halide emulsions include one or more suitable spectral sensitizing dyes to provide the desired blue-light sensitivity. Useful classes of spectral sensitizing dyes include, for example monomethine cyanine dyes, that are derived from substituted benzoxazole, benzothiazole, benzoselenazole, or benzimidazole compounds, or combinations thereof, including the dyes described in U.S. Pat. No. 4,518,689 (Noguchi et al.), incorporated herein by reference. Other details about such compounds are provided by Hamer, *The Cyanine Dyes and Related Compounds,* Interscience, New York, 1964. The useful amounts of such dyes are well known in the art but are generally from about 0.2 to about 2 mmol/mole of silver in the emulsion layer, and preferably from about 0.5 to about 1 mmol/mole of silver in the emulsion layer.

Useful cyanine spectral sensitizing dyes can be represented by the following Structure SS and preferred spectral sensitizing dyes are identified in the Example below as SS-1 and SS-2:

(SS)

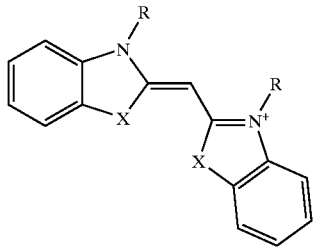

wherein the "R" groups can be the same or different, X is thio, oxy, seleno, imino, and the aromatic rings can be further substituted if desired.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated by *Research Disclosure,* Item 38957, Section VII. Antifoggants and stabilizers, and Item 18431, Section II: Emulsion Stabilizers, Antifoggants and Antikinking Agents.

It may also be desirable that one or more silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or =S moiety. Such compounds include, but are not limited to, 5-mercapotetrazoles, dithioxotriazoles, mercapto-substituted tetraazaindenes, and others described in U.S. Pat. No. 5,876,913 (noted above) that is incorporated herein by reference for the teaching of the sulfur-containing covering power enhancing compounds.

It is essential that the first or second silver halide emulsion layers comprising the tabular grains described above include one more heterocyclic mercaptans such as mercapto-substituted benzothiazoles, mercapto-substituted benzoxazoles, and mercapto-substituted benzimidazoles. Preferably, these heterocyclic mercaptans include a mercapto group (=S or =SH) attached to a carbon atom in the ring that is adjacent a nitrogen atom in the ring.

The heterocyclic rings of these compounds can be further substituted as would be appreciated by one skilled in the art from the teaching in several patents including U.S. Pat. No. 4,013,470 (noted above), that is incorporated herein by reference. Useful substituents include, but are not limited to, substituted or unsubstituted alkyl groups having 1 to 10 carbon atoms, substituted or unsubstituted aryl groups having 6 to 10 carbon atoms in the carbocyclic aromatic ring, hydroxy groups, substituted or unsubstituted alkoxy or aryloxy groups having up to 10 carbon atoms, amino groups, heterocyclyl groups having 5 to 10 atoms in the heterocyclic ring, and additional mercapto groups.

Preferred heterocyclic mercaptans include unsubstituted 2-mercapto-1,3-benzothiazole, unsubstituted 2-mercapto-1,3-benzoxazole, and unsubstituted 2-mercapto-1,3-benzimidazole. The most preferred compound is unsubstituted 2-mercapto-1,3-benzothiazole.

The heterocyclic mercaptans described herein are generally present in the silver halide emulsion layer containing the tabular grains described above in an amount of from about 0.3 to about 1 mmole per mole of total silver, and preferably at from about 0.5 to about 0.8 mmole per mole of total silver, in that emulsion layer. These compounds are readily prepared using known starting materials and reaction methods.

The silver halide emulsion layers and other hydrophilic layers on both sides of the support of the radiographic films generally contain conventional polymer vehicles (peptizers and binders) that include both synthetically prepared and naturally occurring colloids or polymers. Conventional gelatino-vehicles and related layer features are disclosed in *Research Disclosure, Item* 38957, Section II. Vehicles, vehicle extenders, vehicle-like addenda and vehicle related addenda. The emulsions themselves can contain peptizers of the type set out in Section II, paragraph A. Gelatin and hydrophilic colloid peptizers. The hydrophilic colloid peptizers are also useful as binders and hence are commonly present in much higher concentrations than required to perform the peptizing function alone.

Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes and polyacrylamides (including polymethacrylamides). Dextrans can also be used. Examples of such materials are described for example in U.S. Pat. No. 5,876,913 (Dickerson et al.), incorporated herein by reference.

It is essential that the coated tabular grain silver halide emulsion layers on one or both sides of the support comprise tabular silver halide grains dispersed in a hydrophilic polymeric vehicle mixture comprising at least 0.5%, and preferably at least 0.8%, of oxidized gelatin based on the total weight of polymeric vehicle mixture in that coated emulsion layer. The upper limit for the oxidized gelatin is not critical but for practical purposes, it is 1.5% based on the total weight of the polymer vehicle mixture. Preferably, from about 0.8 to about 1.2% (by weight) of the polymer vehicle mixture is oxidized gelatin.

It is also preferred that the oxidized gelatin is in the form of deionized oxidized gelatin but non-deionized oxidized gelatin can be used, or a mixture of deionized and non-deionized oxidized gelatins can be used. Deionized or non-deionized oxidized gelatin generally has the property of relatively lower amounts of methionine per gram of gelatin than other forms of gelatin. Preferably, the amount of methionine is from 0 to about 3 $\mu$mol of methionine, and more preferably from 0 to 1 $\mu$mol of methionine, per gram of gelatin. This material can be prepared using known procedures.

The remainder of the polymeric vehicle mixture can be any of the hydrophilic vehicles described above, but preferably it is composed of alkali-treated gelatin, acid-treated gelatin acetylated gelatin, or phthalated gelatin.

The silver halide emulsions containing the tabular silver halide grains described above can be prepared as noted using a considerable amount of oxidized gelatin (preferably deionized oxidized gelatin) during grain nucleation and growth, and then additional polymeric binder can be added to provide the coating formulation. The amounts of oxidized gelatin in the emulsion can be as low as 0.3 g per mole of silver and as high as 27 g per mole of silver in the emulsion. Preferably, the amount of oxidized gelatin in the emulsion is from about 1 to about 20 g per mole of silver.

The silver halide emulsion layers (and other hydrophilic layers) in the radiographic films are generally fully hardened using one or more conventional hardeners. Thus, the amount of hardener in each silver halide emulsion and other hydrophilic layer is generally at least 0.6% and preferably at least 0.7%, based on the total dry weight of the polymer vehicle in each layer.

Conventional hardeners can be used for this purpose, including but not limited to formaldehyde and free dialdehydes such as succinaldehyde and glutaraldehyde, blocked dialdehydes, α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydi-hydroquinoline, N-carbamoyl pyridinium salts, carbamoyl oxypyridinium salts, bis(amidino) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (for example, mucochloric and mucobromic acids), onium-substituted acroleins, vinyl sulfones containing other hardening functional groups, polymeric hardeners such as dialdehyde starches, and poly (acrolein-co-methacrylic acid).

The levels of silver and polymer vehicle in the radiographic silver halide film of the present invention are as follows. In general, the total amount of silver on each side of the support is at least 17 and no more than 21 mg/dm$^2$ in one or more emulsion layers. Preferably, the amount of silver on each side of the support is from about 17 to about 19 mg/dm$^2$. In addition, the total amount of polymer vehicle on each side of the support is generally at least 22 and no more than 30 mg/dm$^2$ in one or more hydrophilic layers. The amounts of silver and polymer vehicle on the two sides of the support in the radiographic silver halide film can be the same or different. These amounts refer to dry weights.

The radiographic silver halide films of this invention generally include a surface protective overcoat on each side of the support that typically provides physical protection of the emulsion layers. Each protective overcoat can be subdivided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are illustrated by *Research Disclosure,* Item 38957, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. The overcoat on at least one side of the support can also include a blue toning dye or a tetraazaindene (such as 4-hydroxy-6-methyl-1,3,3a,7-tetraazaindene) if desired.

The protective overcoat is generally comprised of one or more hydrophilic colloid vehicles, chosen from among the same types disclosed above in connection with the emulsion layers. Protective overcoats are provided to perform two basic functions. They provide a layer between the emulsion layers and the surface of the film for physical protection of the emulsion layer during handling and processing. Secondly, they provide a convenient location for the placement of addenda, particularly those that are intended to modify the physical properties of the radiographic film.

The various coated layers of radiographic silver halide films of this invention can also contain tinting dyes to modify the image tone to transmitted or reflected light. These dyes are not decolorized during processing and may be homogeneously or heterogeneously dispersed in the various layers. Preferably, such non-bleachable tinting dyes are in a silver halide emulsion layer.

Imaging Assemblies

The radiographic imaging assemblies of the present invention comprise a blue-sensitive, radiographic silver halide film of this invention and one or more fluorescent intensifying screens that emit radiation having a maximum absorption at from about 300 to about 540 nm (preferably from about 360 to about 500 nm). These screens can take any convenient form providing they meet all of the usual requirements for use in radiographic imaging. Examples of conventional, useful fluorescent intensifying screens and methods of making them are provided by *Research Disclosure,* Item 18431, cited above, Section IX. X-Ray Screens/Phosphors, and U.S. Pat. No. 5,021,327 (Bunch et al.), U.S. Pat. No. 4,994,355 (Dickerson et al.), U.S. Pat. No. 4,997,750 (Dickerson et al.), and U.S. Pat. No. 5,108,881 (Dickerson et al.), the disclosures of which are here incorporated by reference. The fluorescent layer contains phosphor particles and a binder, optimally additionally containing a light scattering material, such as titania or light absorbing materials such as particulate carbon, dyes or pigments. Any conventional binder (or mixture thereof) can be used but preferably the binder is an aliphatic polyurethane elastomer or another highly transparent elastomeric polymer.

Any conventional or useful phosphor can be used, singly or in mixtures, in the intensifying screens used in the practice of this invention as long as the emitting radiation has the desired wavelength. For example, useful phosphors are described in numerous references relating to fluorescent intensifying screens, including but not limited to, *Research Disclosure,* Vol. 184, August 1979, Item 18431, Section IX, X-ray Screens/Phosphors.

Suitable phosphors are described in U.S. Pat. No. 4,835,397 (Arakawa et al.) and U.S. Pat. No. 5,381,015 (Dooms), both incorporated herein by reference, and include for example divalent europium and other rare earth activated alkaline earth metal halide phosphors and rare earth element activated rare earth oxyhalide phosphors. Of these types of phosphors, the more preferred phosphors include alkaline earth metal fluorohalide prompt emitting and/or storage phosphors [particularly those containing iodide such as alkaline earth metal fluorobromoiodide storage phosphors as described in U.S. Pat. No. 5,464,568 (Bringley et al.), incorporated herein by reference].

Another class of useful phosphors includes rare earth hosts such as rare earth activated mixed alkaline earth metal sulfates such as europium-activated barium strontium sulfate.

A representative fluorescent intensifying screen useful in the present invention is commercially available as Fuji Film HighPlus Screens that include calcium tungstate as the phosphor.

A particularly useful fluorescent intensifying screen can be prepared using an alkaline earth fluorohalide phosphor and especially a rare earth activated (doped) alkaline earth fluorohalide phosphor. An europium activated barium fluorohalide phosphor is most preferred.

Image Formation

Exposure and processing of the radiographic silver halide films of this invention can be undertaken in any convenient conventional manner. The exposure and processing techniques of U.S. Pat. No. 5,021,327 and U.S. Pat. No. 5,576,156 (both noted above) are typical for processing radiographic films. Other processing compositions (both developing and fixing compositions) are described in U.S. Pat. No. 5,738,979 (Fitterman et al.), U.S. Pat. No. 5,866,309 (Fitterman et al.), U.S. Pat. No. 5,871,890 (Fitterman et al.), U.S. Pat. No. 5,935,770 (Fitterman et al.), U.S. Pat. No. 5,942,378 (Fitterman et al.), all incorporated herein by reference. The processing compositions can be supplied as single- or multi-part formulations, and in concentrated form or as more diluted working strength solutions.

It is particularly desirable that the radiographic silver halide films be processed within 90 seconds ("dry-to-dry") and preferably within 60 seconds (for at least 20 seconds), for the developing, fixing, any washing (or rinsing) and drying steps. Such processing can be carried out in any suitable processing equipment including but not limited to, a Kodak X-OMAT™ RA 480 processor that can utilize Kodak Rapid Access processing chemistry. Other "rapid access processors" are described for example in U.S. Pat. No. 3,545,971 (Barnes et al.) and EP 0 248,390A1 (Akio et al.). Preferably, the black-and-white developing compositions used during processing are free of any gelatin hardeners, such as glutaraldehyde.

Since rapid access processors employed in the industry vary in their specific processing cycles and selections of processing compositions, the preferred radiographic films satisfying the requirements of the present invention are specifically identified as those that are capable of dry-to-dye processing according to the following reference conditions:

| | |
|---|---|
| Development | 11.1 seconds at 35° C., |
| Fixing | 9.4 seconds at 35° C., |
| Washing | 7.6 seconds at 35° C., |
| Drying | 12.2 seconds at 55–65° C. |

Any additional time is taken up in transport between processing steps. Typical black-and-white developing and fixing compositions are described in the Example below.

Radiographic kits can include a radiographic film or imaging assembly of this invention, one or more additional fluorescent intensifying screens and/or metal screens, and/or one or more suitable processing compositions (for example black-and-white developing and fixing compositions).

The following example is presented for illustration and the invention is not to be interpreted as limited thereby.

EXAMPLE

Radiographic Film A (Control)

Radiographic Film A was a dual-coated film having the same silver halide emulsion, interlayer, and overcoat layer on each side of a blue-tinted 178 μm transparent poly (ethylene terephthalate) film support. Each silver halide emulsion layer was a blend of a 3-dimensional silver iodobromide (3.4:96.3 molar ratio) emulsion and an internally fogged silver bromide emulsion. The silver halide grains were chemically sensitized with sodium thiosulfate, potassium tetrachloroaurate, sodium thiocyanate, and dimethylselenourea using conventional procedures. The emulsions were not spectrally sensitized. Radiographic Film A had the following layer arrangement:

Overcoat
Interlayer
Emulsion Layer
Support
Emulsion Layer
Interlayer
Overcoat

The noted layers were prepared from the following formulations.

| | Coverage (mg/dm$^2$) |
|---|---|
| Overcoat Formulation | |
| Gelatin vehicle | 3.4 |
| Methyl methacrylate matte beads | 0.28 |
| Carboxymethyl casein | 0.73 |
| Colloidal silica (LUDOX AM) | 1.06 |
| Polyacrylamide | 0.53 |
| Chrome alum | 0.025 |
| Resorcinol | 0.058 |
| Spermafol lubricant | 0.035 |
| TRITON ® X-200 E surfactant | 0.21 |
| LODYNE S-100 surfactant | 0.0015 |
| PLURONIC ® L43 surfactant | 0.0029 |
| Cysteine glutaraldehyde | $1.42 \times 10^{-5}$ |
| Interlayer Formulation | |
| Gelatin vehicle | 3.4 |
| Carboxymethyl casein | 0.73 |
| Colloidal silica (LUDOX AM) | 1.06 |
| Polyacrylamide | 0.53 |
| Chrome alum | 0.25 |
| Resorcinol | 0.058 |
| PLURONIC ® L43 surfactant | 0.0029 |
| Cysteine glutaraldehyde | $1 \times 10^{-5}$ |
| Emulsion Layer Formulation | |
| 3-Dimensional ("3D", grain emulsion [AgIBr 1.2 μm average size] | 21.6 |
| Fogged grain emulsion [AgBr 0.4 μm average size] | 2.48 |
| Gelatin vehicle | 15.1 |
| 4-Hydroxy-6-methyl-1,3,3a,7-tetraazaindene | 0.8 g/Ag mole |
| Potassium nitrate | 3.81 |
| Maleic acid hydrazide | 1.31 |
| Sorbitol | 1.26 |
| Glycerin | 2.02 |
| 3,5-Disulfocatechol | 4.69 g/Ag mole |
| Carboxymethylcasein | 1.62 |
| Polyacrylamide | 2.7 |
| Dextran | 5.4 |
| Chrome alum | 13.3 g/Ag mole |
| Bisvinylsulfonylmethylether | 0.5% based on total gelatin in all layers on each side |

Radiographic Film B (Control)

The layer arrangement of Film B was like that for Film A and contained the same overcoat and interlayers. The silver halide emulsion layer on each side was the same but different than that in Film A. Specifically, the emulsion disposed on each side of the support contained deionized oxidized gelatin that had been added at multiple times before and/or during the nucleation and early growth of the silver iodobromide tabular grains dispersed therein. The grains had a mean aspect ratio of about 22.5. The nucleation and early growth of the tabular grains were performed using a "bromide-ion-concentration free-fall" process in which a dilute silver nitrate solution was slowly added to a bromide ion-rich deionized oxidized gelatin environment. The iodide was added during grain growth as an Ag-controlling iodobromide salt containing 3.5 mol % iodide, starting after the beginning of growth (at 1.7% of the final grain volume) and ending at 85% of the final grain volume. This provided iodide in a localized portion of the grains of 1.7 to 85% where 100% refers to the grain surface. Between 85% and 100% of the grain volume of the grains was comprised of silver bromide only. The grains were chemically sensitized with aurousdithiosulfate, sodium thiocyanate, and potassium selenocyanate using conventional procedures. Spectral sensitization to the 420–480 nm region was provided using a 50:50 molar blend of SS-1 and SS-2 identified below. The total amount of spectral sensitizing dyes was 500 mg per mole of silver.

More specifically, each emulsion layer contained the following components:

| Emulsion Layer Formulation | Coverage (mg/dm$^2$) |
|---|---|
| Tabular grain emulsion [AgIBr (3:97 mol ratio, 2.7 × 0.12 μm average diameter and thickness] | 18.7 |
| Gelatin vehicle | 20.5 |
| 4-Hydroxy-6-methyl-1,3,3a,7-tetraazaindene | 2.1 g/Ag mole |
| Nitroindazole | 84.5 g/Ag mole |
| Potassium nitrate | 3.81 |
| Sodium disulfocathecol | 4.69 g/Ag mole |
| Maleic acid hydrazide | 1.31 |
| Sorbitol | 1.26 |
| Glycerin | 2.02 |
| Dextran P | 5.4 |
| Carboxymethylcasein | 1.62 |
| Polyacrylamide | 2.7 |
| Chrome alum | 13.3 g/Ag mole |
| Bisvinylsulfonylmethane | 1% based on total gelatin in all layers on each side |

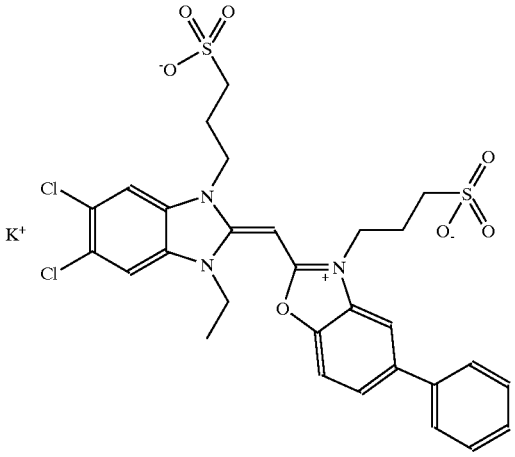

(SS-1)

-continued

| Emulsion Layer Formulation | Coverage (mg/dm$^2$) |
|---|---|

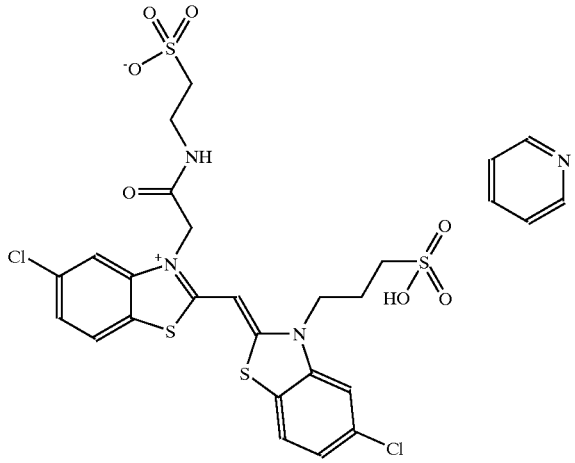

(SS-2)

Radiographic Film C (Control)

This film was like Film B except that the tabular silver halide emulsion also contained 100 mg/silver mole of 2-mercapto-1,3-benzotriazole.

Radiographic Film D (Control)

This film was like Film B except that the tabular silver halide rains comprised 1 mol % silver iodide based on total silver halide and were prepared using oxidized gelatin.

Radiographic Film E (Invention)

This film was like Film D except that the tabular grain silver halide emulsion also contained 100 mg/silver mole of 2-mercapto-1,3-benzotriazole.

Samples of the films were exposed through a graduated density step tablet to a MacBeth sensitometer for 1/50th second to a 500-watt General Electric DMX projector lamp calibrated to 2650° K, filtered with a Corning filter (400–540 nm) to simulate a blue emitting X-ray intensifying screen exposure.

Some film samples were manually processed using the following processing protocol and conditions:

| | | |
|---|---|---|
| Development | 20° C. | 1–8 minutes |
| Stop bath (water or acetic acid) | 20° C. | 30 seconds |
| Fixing | 20° C. | 2 times clearing time |
| Washing | 20° C. | 2–3 minutes |
| KODAK(R) Photo-Flo | 20° C. | 1 minute (optional) |
| Drying | | |

The development times were varied to meet testing needs. The processing solutions were replenished to maintain the level in the processing tank (2.54 cm below the tank top) by adding working strength solutions. All processing was done under safelight.

The processing solutions were as follows:

| Developer: | |
|---|---|
| Hydroquinone | 16 g |
| 4-Hydroxymethyl-4-methyl-1-phenyl-3-pyrazolidone | 0.88 g |
| Potassium bromide | 3.0 g |
| Sodium metabisulflte | 37.1 g |
| Potassium carbonate (47%) | 14.1 g |
| Borax (10 molar) | 1.2 g |
| Potassium hydroxide (45%) | 43.1 g |
| 5-Methylbenzotriazole | 0.026 g |
| Pentetic acid pentasodium salt (40%) | 6.8 g |
| Water to 1 liter, pH 10.3 | |
| Fixer: | |
| Ammonium thiosulfate | 158 g |
| Sodium metabisulfite | 9.2 g |
| Boric acid | 4.4 g |
| Aluminum sulfate | 15.2 g |
| Sodium hydroxide | 10.5 g |
| Tartaric acid | 1.75 g |
| Acetic acid | 11.2 g |
| Water to 1 liter, pH 4.9 | |

Other film samples were developed in each instance for less than seconds using the following developing solution:

| | |
|---|---|
| Hydroquinone | 30 g |
| Phenidone | 1.5 g |
| Potassium hydroxide | 21 g |
| $NaHCO_3$ | 7.5 g |
| Potassium sulfite | 44.2 g |
| $Na_2S_2O_5$ | 12.6 g |
| Sodium bromide | 35 g |

-continued

| | |
|---|---|
| 5-Methylbenzotriazole | 0.06 g |
| Glutaraldehyde | 4.9 g |
| Water to 1 liter, pH 10 | |

Fixing was carried out using KODAK RP X-OMAT® LO Fixer and Replenisher fixing composition (Eastman Kodak Company). Overall processing (dry-to-dry) was carried out using a KODAK® RP X-OMAT® film processor M6A-N, M6B, or M35A within 90 seconds.

Optical densities are expressed below in terms of diffuse density as measured by a conventional X-rite Model 310TM densitometer that was calibrated to ANSI standard PH 2.19 and was traceable to a National Bureau of Standards calibration step tablet. The characteristic D vs. logE curve was plotted for each radiographic film that was imaged and processed. Speed of the combination of radiographic film was measured at a density of $1.2+D_{min}$. Gamma (contrast) is the slope (derivative) of the noted curves. "UDP" is the "upper density point" or the image density measured at the last exposure step. Image tone (b*) is as defined above.

The following TABLE I shows the sensitometric properties of Films A-E from the RP X-OMAT® processing. It is apparent from the data that in an automatic processor, the photographic speeds obtained with the noted films are about the same but the films containing tabular grain emulsions provided higher contrast images. The films with less silver iodide (Films D and E) provided better b* image tone values than Film A–C. However, where the 2-mercapto-1,3-benzotriazole was present (Films C and E), "UDP" was increased. Where the lower silver iodide and 2-mercapto-1,3-benzotriazole were used in combination (Film E), contrast and b* image tone were improved without a significant loss in photographic speed.

The following TABLE II shows the sensitometric properties of Films A-E from manual processing. Photographic speed was measured after 1 minute, 2 minutes, and 8 minutes development time. Contrast was measured at 2 minutes of development time. "Speed loss" refers to the difference in speed between the 8-minute and 1-minutes speed measurements. These data show that the speed after two minutes was about the same for all films. Loss in speed was more evident with Films A–C. While Film D had low speed loss, the contrast was reduced and the contrast was restored in Film E with the addition of the 2-mercapto-1,3-benzotriazole.

Thus, Film E provides the optimal benefits of processability, image tone, and sensitometric properties (speed and contrast) for both automatic and manual processing procedures.

TABLE I

| Film | Grain type (mol % I) | Silver level ($mg/dm^2$) | "MBT" (mg/Ag mole) | Speed | Contrast | UDP | Image Tone |
|---|---|---|---|---|---|---|---|
| A (Control) | "3D" | 21.6 | 0 | 499 | 2.5 | 3.4 | −6.8 |
| B (Control) | Tabular (3%) | 18.7 | 0 | 501 | 3.1 | 3.3 | −6.6 |
| C (Control) | Tabular (3%) | 18.7 | 100 | 490 | 2.8 | 3.7 | −6.5 |
| D (Control) | Tabular (1%) | 18.7 | 0 | 506 | 2.9 | 3.4 | −7.5 |
| E (Invention) | Tabular (1%) | 18.7 | 100 | 501 | 3.3 | 3.7 | −7.4 |

TABLE II

| Film | Grain type (mol % I) | "MBT" (mg/Ag mole) | Speed Loss (8 min.–1 min.) | Speed at 2 minutes | Contrast at 2 minutes |
|---|---|---|---|---|---|
| A (Control) | "3D" | 0 | 51 | 486 | 2.6 |
| B (Control) | Tabular (3%) | 0 | 24 | 494 | 2.6 |
| C (Control) | Tabular (3%) | 100 | 41 | 477 | 2.5 |
| D (Control) | Tabular (1%) | 0 | 9 | 490 | 2.0 |
| E (Invention) | Tabular (1%) | 100 | 28 | 489 | 2.6 |

The invention has been described in detail with particular reference to preferred embodiments thereof, but it will be understood that variations and modifications can be effected within the spirit and scope of the invention.

We claim:

1. A blue-sensitive, radiographic silver halide film comprising a support having first and second major surfaces, said radiographic silver halide film having disposed on said first major support surface, one or more hydrophilic colloid layers including a first silver halide emulsion layer, and on the second major support surface, one or more hydrophilic colloid layers including a second silver halide emulsion layer, said first silver halide emulsion layer comprising predominantly tabular silver halide grains that have an aspect ratio of at least 15, a grain thickness of at least 0.1 μm, and comprise at least 90 mol % bromide and from about 0.5 to about 2.75 mol % iodide, based on total silver halide, substantially all of said iodide being present in an internal localized portion of said tabular silver halide grains that excludes the surface of said grains, wherein said tabular silver halide grains in said first silver halide emulsion layer are dispersed in a hydrophilic polymeric vehicle mixture comprising at least 0.5% of oxidized gelatin, based on the total dry weight of said polymeric vehicle mixture, and wherein said first silver halide emulsion layer further comprises a mercapto-substituted benzothiazole, benzoxazole, or benzimidazole in an amount of at least 0.3 mmole per mole of silver in said silver halide emulsion layer.

2. The radiographic silver halide film of claim 1 wherein said tabular silver halide grains in said first silver halide emulsion layer comprise at least 90% of the total silver halide grains and said tabular silver halide grains comprise at least 95 mol % bromide from about 0.75 to about 2 mol % iodide based on total silver halide in said first silver halide emulsion layer.

3. The radiographic silver halide film of claim 1 wherein said second silver halide emulsion layer comprises predominantly tabular silver halide grains that have an aspect ratio of at least 15, a grain thickness of at least 0.1 μm, and comprise at least 90 mol % bromide and from about 0.5 to about 2.75 mol % iodide, based on total silver halide, substantially all of said iodide being present in an internal localized portion of said tabular silver halide grains that excludes the surface of said grains, wherein said tabular silver halide grains in said second silver halide emulsion layer are dispersed in a hydrophilic polymeric vehicle mixture comprising at least 0.5% of oxidized gelatin, based on the total dry weight of said polymeric vehicle mixture, and wherein said second silver halide emulsion layer further comprises a mercapto-substituted benzothiazole, benzoxazole, or benzimidazole in an amount of at least 0.3 mmole per mole of silver in said first silver halide emulsion layer.

4. The radiographic silver halide film of claim 3 wherein said first and second silver halide emulsion layers comprise up to 1.5% of deionized oxidized gelatin.

5. The radiographic film of claim 1 wherein said first and second silver halide emulsion layers have essentially the same composition.

6. The radiographic silver halide film of claim 1 wherein said tabular silver halide grains in said first silver halide emulsion layer comprise from about 0.5 to about 2 mol % iodide, based on total silver halide, in a localized portion of said grains that is from about 1.5 to about 90 volume % of said grains wherein 100% volume represents the surface of said grains.

7. The radiographic silver halide film of claim 1 wherein said tabular silver halide grains in said first silver halide emulsion layer have an aspect ratio of from about 20 to about 30 and a grain thickness of from about 0.10 to about 0.14 μm.

8. The radiographic silver halide film of claim 1 comprising polymer vehicles on each side of said support in a total amount of from about 22 to about 30 mg/dm$^2$ and a level of silver on each side of said support of from about 17 to about 21 mg/dm$^2$.

9. The radiographic silver halide film of claim 1 wherein said mercapto-substituted benzothiazole, benzoxazole, or benzimidazole is present in an amount of from about 0.3 to about 1 mmole per mole of silver in said first silver halide emulsion layer.

10. The radiographic silver halide film of claim 1 comprising a mercapto-substituted benzothiazole.

11. The radiographic silver halide film of claim 10 wherein said mercapto-substituted benzothiazole is 2-mercapto-1,3-benzothiazole.

12. A blue-sensitive radiographic silver halide film comprising a support having first and second major surfaces, said radiographic silver halide film having disposed on said first major support surface, one or more hydrophilic colloid layers including a first silver halide emulsion layer, and on the second major support surface, one or more hydrophilic colloid layers including a second silver halide emulsion layer, said first and second silver halide emulsion layers having essentially the same composition and comprising predominantly tabular silver halide grains that have an aspect ratio of from about 20 to about 30, a grain thickness of from about 0.10 to about 0.14 μm, and comprising at least 95 mol % bromide and from about 0.5 to about 2 mol % iodide, based on total silver halide in said emulsion layers, substantially all of said iodide being present in an internal localized portion of said tabular silver halide grains that from about 1.7 to about 85 volume % of said grains wherein 100% volume represents the surface of said grains, wherein said tabular silver halide grains in said first and second silver halide emulsion layers are dispersed in a hydrophilic polymeric vehicle mixture comprising from about 0.8% to about 1.2% of deionized oxidized gelatin, based on the total dry weight of said polymeric vehicle mixture, and wherein said first silver halide emulsion layer further comprises 2-mercapto-1,3-benzotriazole, 2-mercapto-1,3-benzoxazole, or 2-mercapto-1,3-benzimidazole at from about 0.5 to about 0.8 mmole per mole of silver in said first silver halide emulsion layer.

13. A photosensitive silver halide emulsion comprising predominantly tabular silver halide grains that have an aspect ratio of at least 15, a grain thickness of at least 0.1 μm, and comprise at least 90 mol % bromide and from about 0.5 to about 2.75 mol % iodide, based on total silver halide, substantially all of the iodide being present in an internal localized portion of said tabular silver halide grains that excludes the surface of said grains, wherein said tabular silver halide grains are dispersed in a hydrophilic polymeric vehicle mixture comprising at least 0.3 g and up to 27 g of oxidized gelatin per mole of silver in said emulsion, and wherein said emulsion further comprises a mercapto-substituted benzothiazole in an amount of at least 0.3 mmole per mole of silver in said first silver halide emulsion layer.

14. The emulsion of claim 13 wherein said mercapto-substituted benzothiazole is 2-mercapto-1,3-benzothiazole, 2-mercapto-1,3-benzoxazole, or 2-mercapto-1,3-benzimidazole.

15. The emulsion of claim 13 wherein at least 90% of the total silver halide grains are tabular silver halide grains that comprise at least 95 mol % bromide and from about 0.75 to about 1.75 mol % iodide based on total silver halide, and 2-mercapto-1,3-benzothiazole is present in an amount from about 0.5 to about 0.8 mmole per mole of silver.

16. A radiographic imaging assembly comprising:

A) the blue-sensitive, radiographic silver halide film of claim 1, and

B) a fluorescent intensifying screen that comprises an inorganic phosphor capable of absorbing X-rays and emitting electromagnetic radiation having a wavelength of from about 360 to about 540 nm, said inorganic phosphor being coated in admixture with a polymeric binder in a phosphor layer onto a flexible support and having a protective overcoat disposed over said phosphor layer.

17. A radiographic imaging assembly comprising:

A) the blue-sensitive, radiographic silver halide film of claim 13, and

B) a fluorescent intensifying screen that comprises a phosphor capable of absorbing X-rays and emitting electromagnetic radiation having a wavelength of from about 360 to about 540 nm, said phosphor being coated in admixture with a polymeric binder in a phosphor layer onto a flexible polymeric support and having a protective overcoat disposed over said phosphor layer.

18. A method of providing a black-and-white image comprising exposing the radiographic imaging assembly of claim 16, and processing said blue-sensitive radiographic silver halide film, sequentially, with a black-and-white developing composition and a fixing composition, said processing being carried out within 90 seconds, dry-to-dry.

19. The method of claim 18 wherein said processing is carried out for 60 seconds or less.

20. The method of providing a black-and-white image comprising exposing the blue-sensitive radiographic silver halide film of claim 1, and processing said blue-sensitive radiographic silver halide film, sequentially, with a black-and-white developing composition and a fixing composition, said processing being carried out within 90 seconds, dry-to-dry.

* * * * *